US010789897B2

(12) United States Patent
Chen

(10) Patent No.: US 10,789,897 B2
(45) Date of Patent: Sep. 29, 2020

(54) METHOD FOR REGULATING COLOR SHIFT IN WHITE BALANCE PROCEDURE OF FOUR-COLOR DISPLAY DEVICE

(71) Applicant: Shenzhen China Star Optoelectronics Technology Co., Ltd., Shenzhen, Guangdong (CN)

(72) Inventor: Lixuan Chen, Guangdong (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 715 days.

(21) Appl. No.: 15/500,109

(22) PCT Filed: Jan. 18, 2017

(86) PCT No.: PCT/CN2017/071486
§ 371 (c)(1),
(2) Date: Jan. 30, 2017

(87) PCT Pub. No.: WO2018/036096
PCT Pub. Date: Mar. 1, 2018

(65) Prior Publication Data
US 2019/0005901 A1 Jan. 3, 2019

(51) Int. Cl.
*G09G 3/36* (2006.01)

(52) U.S. Cl.
CPC ..... *G09G 3/3607* (2013.01); *G09G 3/36* (2013.01); *G09G 2300/0452* (2013.01); *G09G 2320/0242* (2013.01); *G09G 2320/0276* (2013.01)

(58) Field of Classification Search
CPC ..... G09G 3/3607; G09G 3/36; G09G 2300/0452; G09G 2320/0242; G09G 2320/0276
See application file for complete search history.

(56) References Cited

U.S. PATENT DOCUMENTS

2005/0225575 A1* 10/2005 Brown Elliott ..... G09G 3/20 345/694
2010/0231746 A1* 9/2010 Nomura ..... H04N 9/735 348/223.1
(Continued)

FOREIGN PATENT DOCUMENTS

CN 103366655 A 10/2013
CN 103366711 A 10/2013
(Continued)

OTHER PUBLICATIONS

International Search Report, dated Jun. 1, 2017, for International Patent Application No. PCT/CN2017/071486.
(Continued)

*Primary Examiner* — Dmitriy Bolotin

(57) ABSTRACT

Disclosed is a method for regulating color shift in white balance procedure of a four-color display device. The method includes steps of: obtaining brightness of a white color displayed by a combination according to stimulus values Y of a red sub pixel unit, a green sub pixel unit, a blue pixel unit, and a fourth sub pixel unit; and balancing a white color and one shifting color/two shifting colors/three shifting colors using a weighting factor in case of a two-color balance, a three-color balance, or a four-color balance.

20 Claims, 2 Drawing Sheets

(56) References Cited

U.S. PATENT DOCUMENTS

| | | | | |
|---|---|---|---|---|
| 2011/0249016 | A1* | 10/2011 | Zhang | G09G 3/2003 345/589 |
| 2015/0009242 | A1* | 1/2015 | Park | G09G 3/3233 345/690 |
| 2015/0019168 | A1* | 1/2015 | Ohta | G01J 3/505 702/182 |

FOREIGN PATENT DOCUMENTS

| | | | |
|---|---|---|---|
| CN | 104361879 | A | 2/2015 |
| CN | 105096890 | A | 11/2015 |
| CN | 105280124 | A | 1/2016 |
| CN | 105575358 | A | 5/2016 |
| CN | 105679263 | A | 6/2016 |
| CN | 106128382 | A | 11/2016 |
| JP | 2000217122 | A | 8/2000 |
| TW | 201402498 | A | 1/2014 |

OTHER PUBLICATIONS

Chinese Office Action, dated Apr. 26, 2018, for Chinese Patent Application No. 201610715499.3.

* cited by examiner

METHOD FOR REGULATING COLOR SHIFT IN WHITE BALANCE PROCEDURE OF FOUR-COLOR DISPLAY DEVICE

CROSS-REFERENCE TO RELATED APPLICATIONS

This application claims the priority of Chinese patent application CN201610715499.3, entitled "Method for regulating color shift in white balance procedure of four-color display device" and filed on Aug. 24, 2016, the entirety of which is incorporated herein by reference.

FIELD OF THE INVENTION

The present disclosure relates to the technical field of liquid crystal display, and in particular, to a method for regulating color shift in a white balance procedure of a four-color display device.

BACKGROUND OF THE INVENTION

At present, three-color pixel system is commonly used in color display system. Taking a liquid crystal display (LCD) device as an example, each pixel unit is generally composed of three sub pixel units, i.e., a red (R) sub pixel unit, a green (G) sub pixel unit, and a blue (B) sub pixel unit. In a new four-color pixel system, one sub pixel unit is added to the traditional three-color pixel system, and thus a color performance of the four-color pixel system can be improved.

With the development of the four-color pixel system, the three-color to four-color conversion technology is basically mature, and the corresponding product has entered into actual using stage. However, since there is no effective white balance regulation technology for the product with the four-color pixel system, the display effect of the product is not desirable. As a result, the advantage of four-color pixel system is not fully played.

FIG. 1 shows Gamma curves of a four-color pixel system in the prior art, and FIG. 2 shows a standard Gamma curve when white color is displayed. As shown in FIG. 1, curves 1, 2, 3, and 4 are respectively Gamma curves of an LCD with a four-color pixel system when red color, green color, blue color, and white color are displayed. The standard Gamma curve when white color is displayed should fall within a range of −0.2-0.3 with 2.2 as a mid value, so that the brightness change of the white color is in accordance with the perceptual curve of eye, as shown in FIG. 2. The brightness change of the four curves as shown in FIG. 1 all seriously deviate from the aforesaid range at relatively high gray-scale values, and thus an over-bright display effect would be generated.

In order to solve the above technical problem, Patent Document "White Balance Method of Four-color Pixel System" (CN105096890A) provides the following method: lightening a plurality of sub pixel units according to two different combinations respectively based on an input white gray-scale value so as to display a white color; and regulating gray-scale values of each of the sub pixel units, and taking the gray-scale values of each of the sub pixel units, which enable the white color displayed by two different combinations to meet respective preset conditions, as output four color gray-scale values corresponding to the input white gray-scale value.

Gray-scale values of the red sub pixel unit, the green sub pixel unit, and the blue sub pixel unit, which enable a brightness of a white color displayed by a first combination to be equal to a brightness of a white color corresponding to the input white gray-scale value and in accordance with a Gamma curve, and a chromaticity coordinate of a white color displayed by a second combination to be equal to a chromaticity coordinate of a benchmark white color, are taken as an output gray-scale values corresponding to the input white gray-scale value. An output gray-scale value of the fourth sub pixel unit is obtained according to a three-color to four-color calculation algorithm of the four-color pixel system and based on the output gray-scale values of the red sub pixel unit, the green sub pixel unit, and the blue sub pixel unit.

During a regulation procedure of the gray-scale value of each sub pixel unit, a mapping relationship between the gray-scale value of the fourth sub pixel unit and the gray-scale values of the red sub pixel unit, the green sub pixel unit, and the blue sub pixel unit is maintained in accordance with the three-color to four-color calculation algorithm of the four-color pixel system. During the regulation procedure of the gray-scale value of each sub pixel unit, the gray-scale value of the fourth sub pixel unit is maintained unchanged.

The first combination comprises the red sub pixel unit, the green sub pixel unit, the blue sub pixel unit, and the fourth sub pixel unit, and the second combination comprises the red sub pixel unit, the green sub pixel unit, and the blue sub pixel unit. The brightness of the white color displayed by the first combination is obtained according to stimulus values Y of each of the sub pixel units of the first combination, and the chromaticity coordinate of the white color displayed by the second combination is obtained according to tri-stimulus values XYZ of each of the sub pixel units of the second combination.

The gray-scale value of each sub pixel unit is regulated according to formulas as follows:

$$\begin{cases} L_v(W_i) = Y(R_o) + Y(G_o) + Y(B_o) + Y(M_i) \\ x_i = (X(R_o) + X(G_o) + X(B_o))/S \\ y_i = (Y(R_o) + Y(G_o) + Y(B_o))/S \\ M_i = f(R_i, G_i, B_i) \\ M_o = f(R_o, G_o, B_o) \end{cases}, \text{ and}$$

$$\begin{cases} L_v(W_i)/L_v(W_{255}) = (i/255)^{2.2} \\ S = \begin{array}{l} X(R_o) + Y(R_o) + Z(R_o) + X(G_o) + Y(G_o) + Z(G_o) + \\ X(B_o) + Y(B_o) + Z(B_o) \end{array} \end{cases}$$

wherein $L_v(W_i)$ represents a brightness of a white color with a gray-scale value being i; xi, yi represent chromaticity coordinates of the white color; $R_i$, $G_i$, $B_i$, and $M_i$ represent four color gray-scale values obtained through an input three color gray-scale value after conversion according to the three-color to four-color calculation algorithm; $R_o$, $G_o$, $B_o$, and $M_o$ represent output four color gray-scale values; X(·), Y(·), and Z(·) represent tri-stimulus values of each sub pixel unit; and f represents a mapping relationship from the gray-scale values of the red sub pixel unit, the green sub pixel unit, and the blue sub pixel unit to the gray-scale value of the fourth sub pixel unit which is in accordance with the three-color to four-color calculation algorithm.

The brightness of the white color displayed by the first combination is obtained according to stimulus values Y of the red sub pixel unit, the green sub pixel unit, the blue sub pixel unit, and the fourth sub pixel unit, and the chromaticity coordinate of the white color displayed by the second combination is obtained according to tri-stimulus values XYZ of the four sub pixel units.

The gray-scale value of each sub pixel unit is regulated according to formulas as follows:

$$\begin{cases} L_v(W_i) = Y(R_o) + Y(G_o) + Y(B_o) + Y(M_o) \\ x_i = (X(R_o) + X(G_o) + X(B_o) + X(M_o))/S \\ y_i = (Y(R_o) + Y(G_o) + Y(B_o) + Y(M_o))/S \\ M_o = f(R_o, G_o, B_o) \end{cases}, \text{ and}$$

$$\begin{cases} L_v(W_i)/L_v(W_{255}) = (i/255)^{2.2} \\ S = \begin{matrix} X(R_o) + Y(R_o) + Z(R_o) + X(G_o) + Y(G_o) + Z(G_o) + \\ X(B_o) + Y(B_o) + Z(B_o) + X(M_o) + Y(M_o) + Z(M_o) \end{matrix} \end{cases}$$

wherein $L_v(W_i)$ represents a brightness of a white color with a gray-scale value being i; xi, yi represent chromaticity coordinates of the white color; $R_i$, $G_i$, $B_i$, and $M_i$ represent four color gray-scale values obtained through an input three color gray-scale value after conversion according to the three-color to four-color calculation algorithm; $R_o$, $G_o$, $B_o$, and $M_o$ represent output four color gray-scale values; X(·), Y(·), and Z(·) represent tri-stimulus values of each sub pixel unit; and f represents a mapping relationship from the gray-scale values of the red sub pixel unit, the green sub pixel unit, and the blue sub pixel unit to the gray-scale value of the fourth sub pixel unit which is in accordance with the three-color to four-color calculation algorithm.

However, in a process for regulating white balance of a four-color pixel system, the following problems will occur. It may lead to a detrimental result that a mixed color of red and blue, i.e., a violet color in a low gray-scale range shifts out of a correct range of human eye perception when gray-scales of a white color are generally regulated near targets (x,y). That is, under the condition that a chromaticity of the white color is normal, as to the violet color, a red light shift phenomenon occurs at low gray-scales, which shifts out of a range of the violet color. Such a problem does not occur in a traditional three-color white balance system. However, in the four-color pixel system, the fourth sub pixel is used to display the white color together, and the fourth sub pixel is usually not involved in the display of a two-color mixed image such as the violet color, which results in this kind of abnormal phenomenon, as shown in FIGS. 3 and 4.

SUMMARY OF THE INVENTION

Aiming at the above problems in the prior art, i.e., in a four-color pixel system, after a white balance is matched, a phenomenon that a color shifts out of a correct range of human eye perception occurs, the present disclosure provides a method for regulating color shift in white balance procedure of a four-color display device.

S10: obtaining brightness of a white color displayed by a combination according to stimulus values Y of a red sub pixel unit, a green sub pixel unit, a blue pixel unit, and a fourth sub pixel unit, which equals to brightness of a corresponding standard white gamma curve in gray-scale values from 0 to 255; and S20: balancing a white color and one shifting color, or the white color and two shifting colors, or the white color and three shifting colors using a weighting factor in case of a two-color balance, a three-color balance, or a four-color balance.

Preferably, in step 10, a gray-scale value of each sub pixel unit is regulated according to a following expression:

$$L_v(W_i)=Y(R_o)+Y(G_o)+Y(B_o)+Y(M_o)$$

wherein Lv (Wi) represents brightness of a white color with a gray-scale value being i; Ro, Go, Bo, and Mo represent output four color gray-scale values; $Y(R_o)$, $Y(G_o)$, $Y(B_o)$, and $Y(M_o)$ respectively represent stimulus values of each sub pixel unit.

Preferably, in step S20, in situation of the two-color balance, the specific procedure of regulating the color shift in the white balance procedure of the four-color display device is as follows:

dividing gray-scale values from 0 to 255 into two sections: 0 to n and n+1 to 255, two weighting factors a and b corresponding to the section o to n, another two weighting factors c and d corresponding to the section n+1 to 255;

in situation of two-color balance, not only the white color is matched, but also shifting color is balanced;

assuming target chromaticities of the white color as $x_1$ and $y_1$, and target chromaticities of a shifting color as $x_2$ and $y_2$;

thus, $a\times x_1+b\times x_2=(X(R_o)+X(G_o)+X(B_o)+X(M_o))/S$, $a\times y_1+b\times y_2=(Y(R_o)+Y(G_o)+Y(B_o)+Y(M_o))/S$, when 0≤input gray-scale value≤n; and $c\times x_1+d\times x_2=(X(R_o)+X(G_o)+X(B_o)+X(M_o))/S$, $c\times y_1+d\times y_2=(Y(R_o)+Y(G_o)+Y(B_o)+Y(M_o))/S$, when n+1≤input gray-scale value≤255, wherein a+b=1, c+d=1, and $R_o$, $G_o$, $B_o$, and $M_o$ represent output four color gray-scale values; and $$\begin{cases} M_o = f(R_o, G_o, B_o) \\ L_v(W_i)/L_v(W_{255}) = (i/255)^{2.2} \\ S = \begin{matrix} X(R_o) + Y(R_o) + Z(R_o) + X(G_o) + Y(G_o) + Z(G_o) + \\ X(B_o) + Y(B_o) + Z(B_o) + X(M_o) + Y(M_o) + Z(M_o) \end{matrix} \end{cases}$$

wherein X(·),Y(·), and Z(·) respectively represent X, Y, and Z stimulus values of each sub pixel unit, and f represents a mapping relationship from the gray-scale values of the red sub pixel unit, the green sub pixel unit, and the blue sub pixel unit to the gray-scale value of the fourth sub pixel unit which is in accordance with the three-color to four-color calculation algorithm.

Preferably, in situation of the two-color balance, the procedure for acquiring the four-color gray-scale values $R_o$, $G_o$, $B_o$, and $M_o$ in a specific procedure for regulating the color shift in the white balance procedure of the four-color display device can be converted to a procedure for acquiring a minimum Delta. The specific procedure is as follows:

$\text{Delta1}=((X(R_o)+X(G_o)+X(B_o)+X(M_o))/S-x_1)^2+((Y(R_o)+Y(G_o)+Y(B_o)+Y(M_o))/S-y_1)^2$ $\text{Delta2}=((X(R_o)+X(B_o))/S-x_2)^2+((Y(R_o)+Y(B_o))/S-y_2)^2$ Delta=aλDelta1+bλDelta2, wherein a+b=.

Preferably, step S20 of the two-color balance comprises matching the white color, and meanwhile balancing a color shift of violet, a color shift of orange, a color shift of yellow, or a color shift of cyan.

Preferably, in step S20, in situation of the three-color balance, the specific procedure of regulating the color shift in the white balance procedure of the four-color display device is as follows:

dividing gray-scale values from 0 to 255 into two sections: 0 to n and n+1 to 255, three weighting factors e, f, and g corresponding to the section o to n, another three weighting factors h, i, and j corresponding to the section n+1 to 255;

in situation of the three-color balance, not only the white color is matched, but also two shifting colors are balanced;

assuming target chromaticities of the white color as $x_1$ and $y_1$, and target chromaticities of two shifting colors as $x_2$, $y_2$ and $x_3$, $y_3$;

thus, $e\times x_1+f\times x_2+g\times x_3=(X(R_o)+X(G_o)+X(B_o)+X(M_o)/S$, $e\times y_1+f\times y_2+g\times y_3=(Y(R_o)+Y(G_o)+Y(B_o)+Y(M_o))/S$, when 0≤input gray-scale value≤n; and $h\times x_1+i\times x_2+j\times x_3=(X(R_o)+X(G_o)+X(B_o)+X(M_o))/S$, $h\times y_1+i\times y_2+j\times y_3=(Y(R_o)+Y(G_o)+Y(B_o)+Y(M_o))/S$, when n+1≤input gray-scale value≤255 wherein e+f+g=1, h+i+j=1, and $R_o$, $G_o$, $B_o$, and $M_o$ represent output four color gray-scale values;

and $$\begin{cases} M_o = f(R_o, G_o, B_o) \\ L_v(W_i)/L_v(W_{255}) = (i/255)^{2.2} \\ S = \begin{matrix} X(R_o)+Y(R_o)+Z(R_o)+X(G_o)+Y(G_o)+Z(G_o)+ \\ X(B_o)+Y(B_o)+Z(B_o)+X(M_o)+Y(M_o)+Z(M_o) \end{matrix} \end{cases}$$

wherein X(·),Y(·), and Z(·) respectively represent X, Y, and Z stimulus values of each sub pixel unit, and f represents a mapping relationship from the gray-scale values of the red sub pixel unit, the green sub pixel unit, and the blue sub pixel unit to the gray-scale value of the fourth sub pixel unit which is in accordance with the three-color to four-color calculation algorithm.

Preferably, step S20 of the three-color balance comprises matching the white color, and meanwhile balancing color shifts of violet and orange, or color shifts of violet and yellow, color shifts of violet and cyan, color shifts of orange and yellow, color shifts of orange and cyan, or color shifts of yellow and cyan.

Preferably, in step S20, in situation of the four-color balance, the specific procedure of regulating the color shift in the white balance procedure of the four-color display device is as follows:

dividing gray-scale values from 0 to 255 into two sections: 0 to n and n+1 to 255, four weighting factors k, l, m, and n corresponding to the section o to n, another four weighting factors o, p, q, and r corresponding to the section n+1 to 255;

in situation of the four-color balance, not only the white color is matched, but also three shifting colors are balanced;

assuming target chromaticities of the white color as $x_1$ and $y_1$, and target chromaticities of three shifting colors as ($x_2$, $y_2$), ($x_3$, $y_3$), and $x_4$, $y_4$;

thus, $k\times x_1+l\times x_2+m\times x_3+n\times x_4=(X(R_o)+X(G_o)+X(B_o)+X(M_o))/S$, $k\times y_1+l\times y_2+m\times y_3+n\times y_4=(Y(R_o)+Y(G_o)+Y(B_o)+Y(M_o))/S$, when 0≤input gray-scale value≤n'; and $o\times x+p\times x_2+q\times x_3+r\times x_4=(X(R_o)+X(G_o)+X(B_o)+X(M_o))/S$, $o\times y_1+p\times y_2+q\times y_3+r\times y_4=(Y(R_o)+Y(G_o)+Y(B_o)+Y(M_o))/S$, when n+1≤input gray-scale value≤255 wherein k+l+m+n=1, o+p+q+r=1, and R, $G_o$, $B_o$, and $M_o$ represent output four color gray-scale values;

and $$\begin{cases} M_o = f(R_o, G_o, B_o) \\ L_v(W_i)/L_v(W_{255}) = (i/255)^{2.2} \\ S = \begin{matrix} X(R_o)+Y(R_o)+Z(R_o)+X(G_o)+Y(G_o)+Z(G_o)+ \\ X(B_o)+Y(B_o)+Z(B_o)+X(M_o)+Y(M_o)+Z(M_o) \end{matrix} \end{cases}$$

wherein X(·),Y(·), and Z(·) respectively represent X, Y, and Z stimulus values of each sub pixel unit, and f represents a mapping relationship from the gray-scale values of the red sub pixel unit, the green sub pixel unit, and the blue sub pixel unit to the gray-scale value of the fourth sub pixel unit which is in accordance with the three-color to four-color calculation algorithm.

Preferably, step S20 of the four-color balance comprises matching the white color, and meanwhile balancing color shifts of violet, orange, and yellow, color shifts of violet, orange, and cyan, color shifts of violet, yellow and cyan, or color shifts of orange, yellow, and cyan.

Preferably, in situation of the two-color balance, the three-color balance, or the four-color balance, a value constraint for the n during the specific procedure for regulating the color shift in the white balance procedure of the four-color display device is: n is less than a gray-scale value corresponding to an inflexion of a chromaticity curve after white balance in a four-color pixel system.

Compared with the prior art, one embodiment or more embodiments of the above technical solutions can have following advantages or beneficial effects.

In situation of the two-color balance, i.e., the condition that shift of one color occurs, a first target color (the white color) and a second target color are weighed using a weighting factor to achieve the purpose that no distortion of the two colors is perceptible by naked eye, so that the display effect of the four-color display device can be improved.

In situation of the three-color balance or the four-color balance, i.e., the condition that shift of two or three colors occurs, through the adjustment of the weighting factor, each color deviates from the target in different degrees, but it will not deviate too much and will not cause distortion which is perceptible by naked eye.

Other advantages, objectives, and features of the present disclosure will be further explained in the following description, and partially become self-evident therefrom, or be understood through the embodiments of the present disclosure. The objectives and advantages of the present disclosure will be achieved through the structure specifically pointed out in the description, claims, and the accompanying drawings.

BRIEF DESCRIPTION OF THE DRAWINGS

The present disclosure will be illustrated in detail hereinafter with reference to the embodiments and the accompanying drawings. In the drawings.

Figure 1:
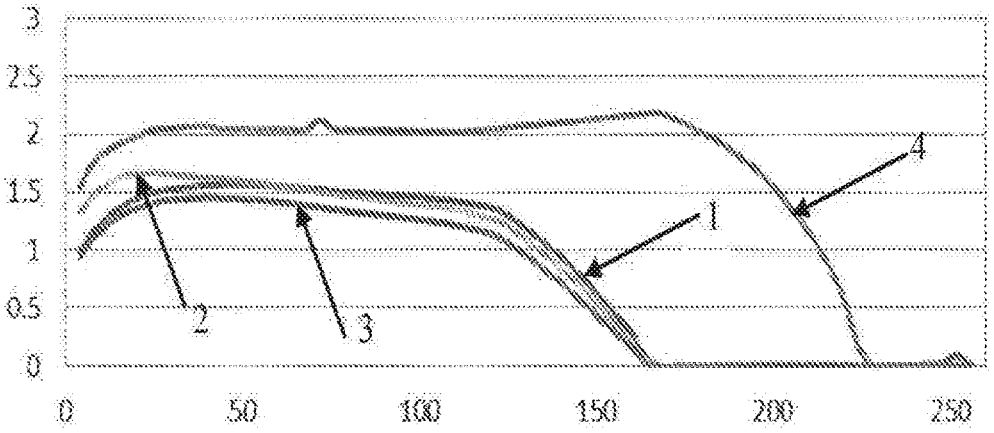
Fig. 1 (Prior Art)
FIG. 1 schematically shows standard Gamma curves of a four-color pixel system in the prior art.
Figure 2:
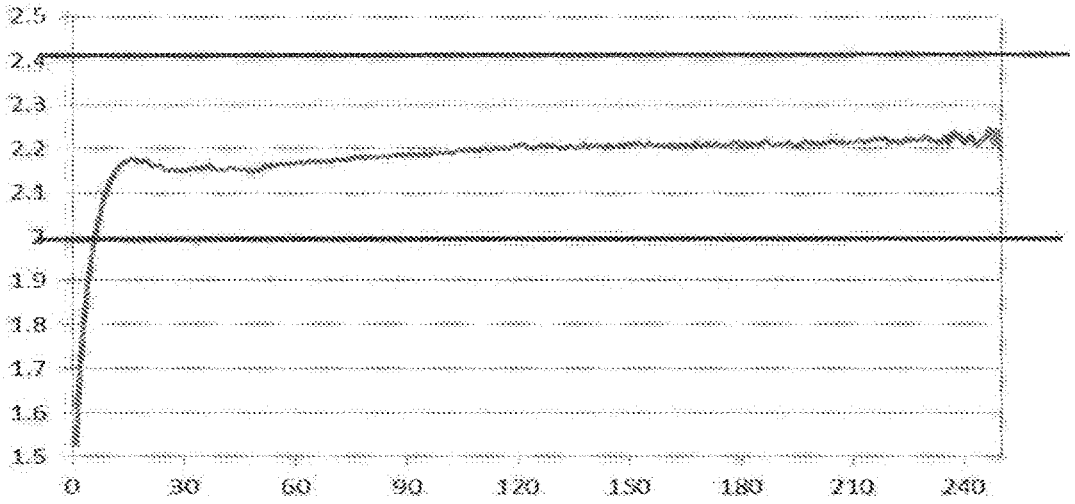
Fig. 2 (Prior Art)
FIG. 2 schematically shows a standard Gamma curve when white color is displayed.

In the drawings, the same components are represented by the same reference signs, and the size of each component does not represent the actual size of the corresponding component.

DETAILED DESCRIPTION OF THE EMBODIMENTS

The present disclosure will be illustrated further with reference to the drawings.

Figure 3:
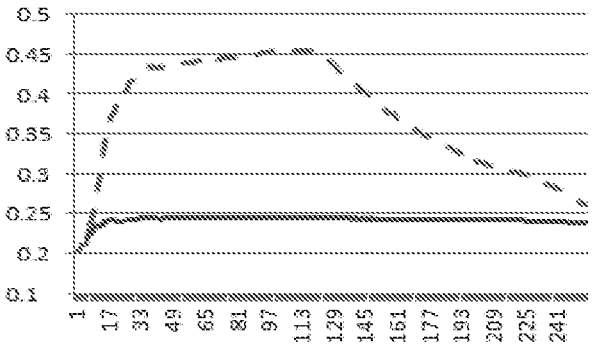
Fig. 3 (Prior Art)
In FIG. 3, a solid line shows a normal chromaticity curve of violet color (X axis), and a dotted line shows a chromaticity curve after a white balance in a four-color pixel system (X axis)
Figure 4:
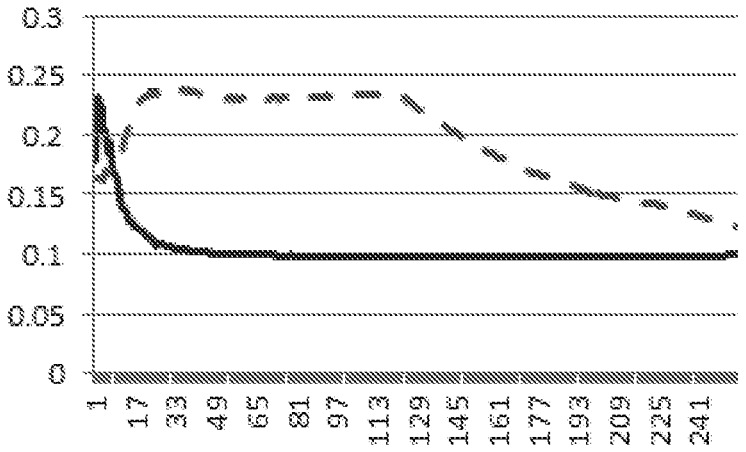
Fig. 4 (Prior Art)
In FIG. 4, a solid line shows a normal chromaticity curve of violet color (Y axis), and a dotted line shows a chromaticity curve after a white balance in a four-color pixel system (Y axis)

In FIG. 3, a solid line shows a normal chromaticity curve of violet color (X axis), and a dotted line shows a chromaticity curve after a white balance in a four-color pixel system (X axis). In FIG. 4, a solid line shows a normal chromaticity curve of violet color (Y axis), and a dotted line shows a chromaticity curve after a white balance in a four-color pixel system (Y axis).

Embodiment 1

Figure 5:
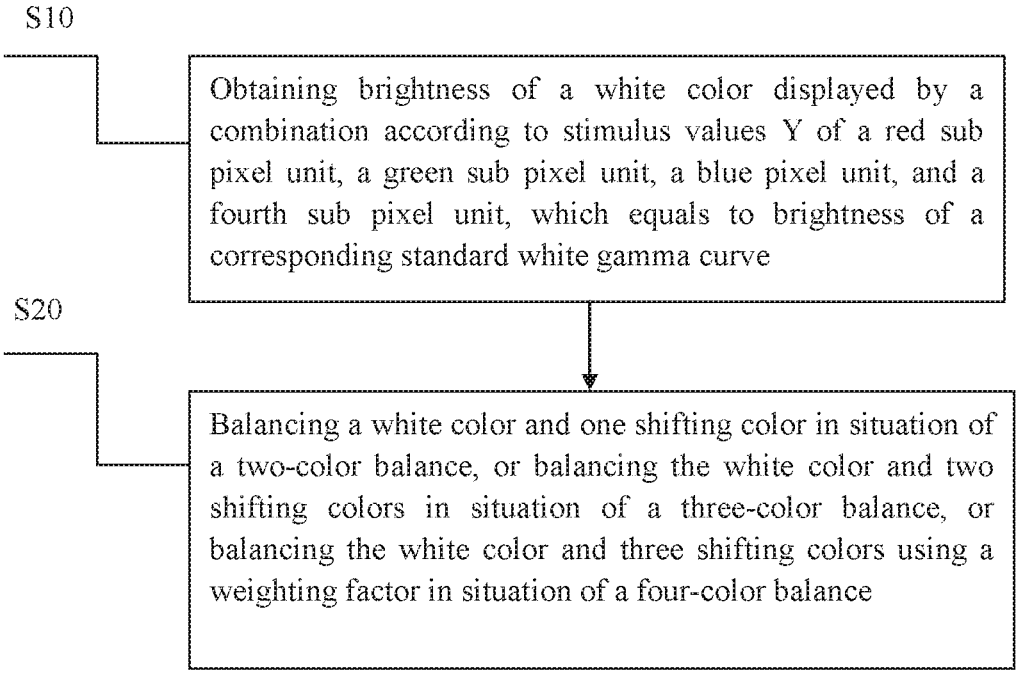
FIG. 5 is a flow chart of a method for regulating color shift in a white balance procedure of a four-color display device in the present disclosure.

As shown in FIG. 5, the present embodiment provides a method for regulating a color shift in a white balance procedure of a four-color display device, which is carried out in accordance with following steps.

Brightness of a white color displayed by a combination is obtained according to stimulus values Y of a red sub pixel unit, a green sub pixel unit, a blue pixel unit, and a fourth sub pixel unit, which equals to brightness of a corresponding standard white gamma curve in gray-scale values from 0 to 255.

$$L_v(W_i)=Y(R_o)+Y(G_o)+Y(B_o)+Y(M_o)$$

wherein Lv ($W_i$) represents brightness of a white color with a gray-scale value being i; Ro, Go, Bo, and Mo represent output four color gray-scale values; and $Y(R_o)$, $Y(G_o)$, $Y(B_o)$, and $Y(M_o)$ respectively represent stimulus values of each sub pixel unit.

Gray-scale values from 0 to 255 are divided into two sections: 0 to n and n+1 to 255. Two weighting factors a and b correspond to the section o to n, and another two weighting factors c and d correspond to the section n+1 to 255.

In situation of the two-color balance, not only the white color is matched, but also a shifting color is balanced.

Target chromaticities of the white color are assumed as $x_1$ and $y_1$, and target chromaticities of the shifting color are determined as $x_2$ and $y_2$;

thus, $a\times x_1+b\times x_2=(X(R_o)+X(G_o)+X(B_o)+X(M_o))/S$, $a\times y_1+b\times y_2=(Y(R_o)+Y(G_o)+Y(B_o)+Y(M_o))/S$, when 0≤input gray-scale value≤n; and $c\times x_1+d\times x_2=(X(R_o)+X(G_o)+X(B_o)+X(M_o))/S$, $c\times y_1+d\times y_2=(Y(R_o)+Y(G_o)+Y(B_o)+Y(M_o))/S$, when n+1 input gray-scale value≤255, wherein a+b=1, c+d=1, and $R_o$, $G_o$, $B_o$, and $M_o$ represent output four color gray-scale values;

and $$\begin{cases} M_o = f(R_o, G_o, B_o) \\ L_v(W_i)/L_v(W_{255}) = (i/255)^{2.2} \\ S = \dfrac{X(R_o)+Y(R_o)+Z(R_o)+X(G_o)+Y(G_o)+Z(G_o)+}{X(B_o)+Y(B_o)+Z(B_o)+X(M_o)+Y(M_o)+Z(M_o)} \end{cases}$$

wherein X(·),Y(·), and Z(·) respectively represent X, Y, and Z stimulus values of each sub pixel unit, and f represents a mapping relationship from the gray-scale values of the red sub pixel unit, the green sub pixel unit, and the blue sub pixel unit to the gray-scale value of the fourth sub pixel unit which is in accordance with the three-color to four-color calculation algorithm.

The embodiment can have following beneficial effects. In situation of the two-color balance, i.e., the condition that shift of one color occurs, a first target color (the white color) and a second target color are weighed using a weighting factor to achieve the purpose that no distortion of the two colors is perceptible by naked eye, so that the display effect of the four-color display device can be improved.

Embodiment 2

The present embodiment is a further explanation of the method for regulating the color shift in the white balance procedure of the four-color display device according to embodiment 1. In the process of the two-color balance, a white color is matched, and meanwhile color shift of violet is regulated.

Embodiment 3

The present embodiment is a further explanation of the method for regulating the color shift in the white balance procedure of the four-color display device according to embodiment 1. In the process of the two-color balance, a white color is matched, and meanwhile color shift of orange is regulated.

Embodiment 4

The present embodiment is a further explanation of the method for regulating the color shift in the white balance procedure of the four-color display device according to embodiment 1. In the process of the two-color balance, a white color is matched, and meanwhile color shift of yellow is regulated.

Embodiment 5

The present embodiment is a further explanation of the method for regulating the color shift in the white balance procedure of the four-color display device according to embodiment 1. In the process of the two-color balance, a white color is matched, and meanwhile color shift of cyan is regulated.

Embodiment 6

As shown in FIG. 5, the present embodiment provides a method for regulating color shift in a white balance procedure of a four-color display device, which is carried out in accordance with following steps.

Brightness of a white color displayed by a combination is obtained according to stimulus values Y of a red sub pixel unit, a green sub pixel unit, a blue pixel unit, and a fourth sub pixel unit, which equals to brightness of a corresponding standard white gamma curve in gray-scale values from 0 to 255.

$$L_v(W_i)=Y(R_o)+Y(G_o)+Y(B_o)+Y(M_o),$$

wherein Lv (Wi) represents brightness of a white color with a gray-scale value being i; Ro, Go, Bo, and Mo represent output four color gray-scale values; and $Y(R_o)$, $Y(G_o)$, $Y(B_o)$, and $Y(M_o)$ respectively represent stimulus values of each sub pixel unit.

Gray-scale values from 0 to 255 are divided into two sections: 0 to n and n+1 to 255. Three weighting factors e, f, and g correspond to the section o to n, and another three weighting factors h, i, and j correspond to the section n+1 to 255.

In situation of the three-color balance, not only the white color is matched, but also the two shifting colors are balanced.

Target chromaticities of the white color are assumed as $x_1$ and $y_1$, and target chromaticities of the two shifting colors are assumed as $x_2$, $y_2$, and $x_3$, $y_3$;

thus, $e\times x_1+f\times x_2+g\times x_3=(X(R_o)+X(G_o)+X(B_o)+X(M_o))/S$, $e\times y_1+f\times y_2+g\times y_3=(Y(R_o)+Y(G_o)+Y(B_o)+Y(M_o)/S$, when 0≤input gray-scale value≤n; and $h\times x_1+i\times x_2+j\times x_3=(X(R_o)+X(G_o)+X(B_o)+X(M_o))/S$, $h\times y_1+i\times y_2+j\times y_3(Y(R_o)+Y(G_o)+Y(B_o)+Y(M_o))/S$, when n+1≤input gray-scale value≤255, wherein e+f+g=1, h+i+j=1, and $R_o$, $G_o$, $B_o$, and $M_o$ represent output four color gray-scale values;

and $$\begin{cases} M_o = f(R_o, G_o, B_o) \\ L_v(W_i)/L_v(W_{255}) = (i/255)^{2.2} \\ S = \begin{matrix} X(R_o)+Y(R_o)+Z(R_o)+X(G_o)+Y(G_o)+Z(G_o)+ \\ X(B_o)+Y(B_o)+Z(B_o)+X(M_o)+Y(M_o)+Z(M_o) \end{matrix} \end{cases}$$

wherein X(·),Y(·), and Z(·) respectively represent X, Y, and Z stimulus values of each sub pixel unit, and f represents a mapping relationship from the gray-scale values of the red sub pixel unit, the green sub pixel unit, and the blue sub pixel unit to the gray-scale value of the fourth sub pixel unit which is in accordance with the three-color to four-color calculation algorithm.

The present embodiment can have following beneficial effects. In situation of the three-color balance, i.e., the condition that shift of two colors occurs, through the adjustment of the weighting factor, each color deviates from the target in different degrees, but it will not deviate too much and will not cause distortion which is perceptible by naked eye.

Embodiment 7

The present embodiment is a further explanation of the method for regulating the color shift in the white balance procedure of the four-color display device according to embodiment 6. In the process of the three-color balance, a white color is matched, and meanwhile color shifts of violet and orange are regulated.

Embodiment 8

The present embodiment is a further explanation of the method for regulating the color shift in the white balance procedure of the four-color display device according to embodiment 6. In the process of the three-color balance, a white color is matched, and meanwhile color shifts of violet and yellow are regulated.

Embodiment 9

The present embodiment is a further explanation of the method for regulating the color shift in the white balance procedure of the four-color display device according to embodiment 6. In the process of the three-color balance, a white color is matched, and meanwhile color shifts of violet and cyan are regulated.

Embodiment 10

The present embodiment is a further explanation of the method for regulating the color shift in the white balance procedure of the four-color display device according to embodiment 6. In the process of the three-color balance, a white color is matched, and meanwhile color shifts of orange and yellow are regulated.

Embodiment 11

The present embodiment is a further explanation of the method for regulating the color shift in the white balance procedure of the four-color display device according to embodiment 6. In the process of the three-color balance, a white color is matched, and meanwhile color shifts of orange and cyan are regulated.

Embodiment 12

The present embodiment is a further explanation of the method for regulating the color shift in the white balance procedure of the four-color display device according to embodiment 6. In the process of the three-color balance, a white color is matched, and meanwhile color shifts of yellow and cyan are regulated.

Embodiment 13

As shown in FIG. 5, the present embodiment provides a method for regulating a color shift in a white balance procedure of a four-color display device, which is carried out in accordance with following steps.

Brightness of a white color displayed by a combination is obtained according to stimulus values Y of a red sub pixel unit, a green sub pixel unit, a blue pixel unit, and a fourth sub pixel unit, which equals to brightness of a corresponding standard white gamma curve in gray-scale values from 0 to 255.

$$L_v(W_i)=Y(R_o)+Y(G_o)+Y(B_o)+Y(M_o),$$

wherein Lv ($W_i$) represents brightness of a white color with a gray-scale value being i; Ro, Go, Bo, and Mo represent output four color gray-scale values; and $Y(R_o)$, $Y(G_o)$, $Y(B_o)$, and $Y(M_o)$ respectively represent stimulus values of each sub pixel unit.

Gray-scale values from 0 to 255 are divided into two sections: 0 to n and n+1 to 255. Four weighting factors k, l, m, and n correspond to the section o to n, another four weighting factors o, p, q, and r correspond to the section n+1 to 255.

In situation of the four-color balance, not only the white color is matched, but also the three shifting colors are balanced.

Target chromaticities of the white color are assumed as $x_1$ and $y_1$, and target chromaticities of the three shifting colors are assumed as ($x_2$, $y_2$), ($x_3$, $y_3$), and $x_4$, $y_4$;

thus, $k\times x_1+l\times x_2+m\times x_3+n\times x_4=(X(R_o)+X(G_o)+X(B_o)+X(M_o))/S$, $k\times y_1+l\times y_2+m\times y_3+n\times y_4=(Y(R_o)+Y(G_o)+Y(B_o)+Y(M_o))/S$, when 0≤input gray-scale value≤n'; and $o\times x_1+p\times x_2+q\times x_3+r\times x_4=(X(R_o)+X(G_o)+X(B_o)+X(M_o)/S$, $o\times y_1+p\times y_2+q\times y_3+r\times y_4=(Y(R_o)+Y(G_o)+Y(B_o)+Y(M_o))/S$, when n+1≤:input gray-scale value≤255, wherein k+l+m+n=, o+p+q+r=1, and $R_o$, $G_o$, $B_o$, and $M_o$ represent output four color gray-scale values, and $$\begin{cases} M_o = f(R_o, G_o, B_o) \\ L_v(W_i)/L_v(W_{255}) = (i/255)^{2.2} \\ S = \begin{matrix} X(R_o)+Y(R_o)+Z(R_o)+X(G_o)+Y(G_o)+Z(G_o)+ \\ X(B_o)+Y(B_o)+Z(B_o)+X(M_o)+Y(M_o)+Z(M_o) \end{matrix} \end{cases}$$

wherein X(·),Y(·), and Z(·) respectively represent X, Y, and Z stimulus values of each sub pixel unit, and f represents a mapping relationship from the gray-scale values of the red sub pixel unit, the green sub pixel unit, and the blue sub pixel unit to the gray-scale value of the fourth sub pixel unit which is in accordance with the three-color to four-color calculation algorithm.

The present embodiment can have following beneficial effects. In situation of the four-color balance, i.e., the condition that shift of three colors occurs, through the adjustment of the weighting factor, each color deviates from the target in different degrees, but it will not deviate too much and will not cause distortion which is perceptible by naked eye.

Embodiment 14

The present embodiment is a further explanation of the method for regulating the color shift in the white balance procedure of the four-color display device according to embodiment 13. In the process of the three-color balance, a white color is matched, and meanwhile color shifts of violet, orange and yellow are regulated.

Embodiment 15

The present embodiment is a further explanation of the method for regulating the color shift in the white balance procedure of the four-color display device according to embodiment 13. In the process of the three-color balance, a white color is matched, and meanwhile color shifts of violet, orange and cyan are regulated.

Embodiment 16

The present embodiment is a further explanation of the method for regulating the color shift in the white balance procedure of the four-color display device according to embodiment 13. In the process of the three-color balance, a white color is matched, and meanwhile color shifts of violet, yellow and cyan are regulated.

Embodiment 17

The present embodiment is a further explanation of the method for regulating the color shift in the white balance procedure of the four-color display device according to embodiment 13. In the process of the three-color balance, a white color is matched, and meanwhile color shifts of orange, yellow and cyan are regulated.

Embodiment 18

The present embodiment is a further explanation of the method for regulating the color shift in the white balance procedure of the four-color display device according to embodiments 1 to 5. The procedure for acquiring four-color gray-scale values $R_o$, $G_o$, $B_o$, and $M_o$ can be converted to a procedure for acquiring a minimum Delta. The specific procedure is as follows.

$$\text{Delta1}=((X(R_o)+X(G_o)+X(B_o)+X(M_o))/S-x_1)^2+((Y(R_o)+Y(G_o)+Y(B_o)+Y(M_o))/S-y_1)^2$$

$$\text{Delta2}=((X(R_o)+X(B_o))/S-x_2)^2+((Y(R_o)+Y(B_o)/S-y_2)^2$$

$$\text{Delta}=a\times\text{Delta1}+b\times\text{Delta2}, \text{ wherein } a+b=^1.$$

Specifically, Delta 1 is a sum of squares of a difference between actual chromaticity coordinates $(X(R_o)+X(G_o)+X(B_o)+X(M_o))/S$ and a target $x_1$ and a difference between $(X(R_o)+X(G_o)+X(B_o)+X(M_o))/S$ and a target $y_1$, or a square of a distance between an actual color and a target color in a chromaticity space. Similarly, Delta 2 is a distance between the actual chromaticity coordinates and targets $(x_2, y_2)$.

Embodiment 19

The present embodiment is a further explanation of the method for regulating the color shift in the white balance procedure of the four-color display device according to embodiments 1 to 18. A value constraint for n is: n is less than a gray-scale value corresponding to an inflexion of a chromaticity curve after white balance in a four-color pixel system.

The present disclosure is illustrated hereinabove with reference to the specific embodiments, which are only examples of the principle and use of the present disclosure. Those skilled in the art can make amendments to the embodiments disclosed herein or provide other arrangements without departing from the spirit and scope of the present disclosure. The technical feature described in one embodiment can also be used in other embodiments.

The invention claimed is:

1. A method for regulating color shift in a white balance procedure of a four-color display device, comprising steps of:

S10: obtaining brightness of a white color displayed by a combination according to stimulus values Y of a red sub pixel unit, a green sub pixel unit, a blue pixel unit, and a fourth sub pixel unit, which equals to brightness of a corresponding standard white gamma curve in gray-scale values from 0 to 255; and S20: balancing a white color and one shifting color, or the white color and two shifting colors, or the white color and three shifting colors using a weighting factor in case of a two-color balance, a three-color balance, or a four-color balances;

wherein the two-color balance refers to matching the white color, and meanwhile balancing a color shift of violet, or meanwhile balancing a color shift of orange, or meanwhile balancing a color shift of yellow, or meanwhile balancing a color shift of cyan.

2. The method for regulating the color shift in the white balance procedure of the four-color display device according to claim 1, wherein in step S10, a gray-scale value of each sub pixel unit is regulated according to a following expression:

$$L_v(W_i)=Y(R_o)+Y(G_o)+Y(B_o)+Y(M_o),$$

wherein Lv (Wi) represents brightness of a white color with a gray-scale value being i; Ro, Go, Bo, and Mo represent output four color gray-scale values; and $Y(R_o)$, $Y(G_o)$, $Y(B_o)$, and $Y(M_o)$ respectively represent stimulus values of each sub pixel unit.

3. The method for regulating the color shift in the white balance procedure of the four-color display device according to claim 1, wherein in step S20, in situation of the two-color balance, weighting factors are assigned according to following ways, so that the color shift in the white balance procedure of the four-color display device is regulated:

dividing gray-scale values from 0 to 255 into two sections: 0 to n and n+1 to 255, two weighting factors a and b corresponding to the section o to n, another two weighting factors c and d corresponding to the section n+1 to 255;

assuming target chromaticities of the white color as $x_1$ and $y_1$, and target chromaticities of a shifting color as $x_2$ and $y_2$;

thus, $a\times x_1+b\times x_2=(X(R_o)+X(G_o)+X(B_o)+X(M_o))/S$, $a\times y_1+b\times y_2=(Y(R_o)+Y(G_o)+Y(B_o)+Y(M_o))/S$, when 0≤input gray-scale value≤n; and $c\times x_1+d\times x_2=(X(R_o)+X(G_o)+X(B_o)+X(M_o))/S$, $c\times y_1+d\times y_2=(Y(R_o)+Y(G_o)+Y(B_o)+Y(M_o))/S$, when n+1≤input gray-scale value≤255, wherein a+b=1, c+d=1, and $R_o$, $G_o$, $B_o$, and $M_o$ represent output four color gray-scale values; and $$\begin{cases} M_o = f(R_o, G_o, B_o) \\ L_v(W_i)/L_v(W_{255}) = (i/255)^{2.2} \\ S = \begin{matrix} X(R_o)+Y(R_o)+Z(R_o)+X(G_o)+Y(G_o)+Z(G_o)+ \\ X(B_o)+Y(B_o)+Z(B_o)+X(M_o)+Y(M_o)+Z(M_o) \end{matrix} \end{cases}$$

wherein X(·),Y(·), and Z(·) respectively represent X, Y, and Z stimulus values of each sub pixel unit, and f represents a mapping relationship from the gray-scale values of the red sub pixel unit, the green sub pixel unit, and the blue sub pixel unit to the gray-scale value of the fourth sub pixel unit which is in accordance with the three-color to four-color calculation algorithm.

4. The method for regulating the color shift in the white balance procedure of the four-color display device according to claim 3, wherein the two-color balance refers to matching the white color, and meanwhile balancing a color shift of violet, or meanwhile balancing a color shift of orange, or meanwhile balancing a color shift of yellow, or meanwhile balancing a color shift of cyan.

5. The method for regulating color shift in white balance procedure of the four-color display device according to claim 3, wherein n is less than a gray-scale value corresponding to an inflexion of a chromaticity curve after white balance in a four-color pixel system.

6. The method for regulating the color shift in the white balance procedure of the four-color display device according to claim 1, wherein in step S20, in situation of the three-color balance, weighting factors are assigned according to following ways, so that color shift in white balance procedure of the four-color display device is regulated:

dividing gray-scale values from 0 to 255 into two sections: 0 to n and n+1 to 255, three weighting factors e, f, and g corresponding to the section o to n, another three weighting factors h, i, and j corresponding to the section n+1 to 255;

assuming target chromaticities of the white color as $x_1$ and $y_1$, and target chromaticities of two shifting colors as $x_2$, $y_2$ and $x_3$, $y_3$;

thus, $e\times x_1+f\times x_2+g\times x_3=(X(R_o)+X(G_o)+X(B_o)+X(M_o))/S$, $e\times y_1+f\times y_2+g\times y_3=(Y(R_o)+Y(G_o)+Y(B_o)+Y(M_o))/S$, when 0≤input gray-scale value≤n; and $h\times x_1+i\times x_2+j\times x_3=(X(R_o)+X(G_o)+X(B_o)+X(M_o))/S$, $h\times y_1+i\times y_2+j\times y_3=(Y(R_o)+Y(G_o)+Y(B_o)+Y(M_o))/S$, when n+1≤input gray-scale value≤255, wherein e+f+g=1, h+i+j=1, and $R_o$, $G_o$, $B_o$, and $M_o$ represent output four color gray-scale values;

and $$\begin{cases} M_o = f(R_o, G_o, B_o) \\ L_v(W_i)/L_v(W_{255}) = (i/255)^{2.2} \\ S = \begin{matrix} X(R_o)+Y(R_o)+Z(R_o)+X(G_o)+Y(G_o)+Z(G_o)+ \\ X(B_o)+Y(B_o)+Z(B_o)+X(M_o)+Y(M_o)+Z(M_o) \end{matrix} \end{cases}$$

wherein X(·),Y(·), and Z(·) respectively represent X, Y, and Z stimulus values of each sub pixel unit, and f represents a mapping relationship from the gray-scale values of the red sub pixel unit, the green sub pixel unit, and the blue sub pixel unit to the gray-scale value of the fourth sub pixel unit which is in accordance with the three-color to four-color calculation algorithm.

7. The method for regulating the color shift in the white balance procedure of the four-color display device according to claim 6, wherein the three-color balance refers to matching the white color, and meanwhile balancing color shifts of violet and orange, or meanwhile balancing color shifts of violet and yellow, or meanwhile balancing color shifts of violet and cyan, or meanwhile balancing color shifts of orange and yellow, or meanwhile balancing color shifts of orange and cyan, or meanwhile balancing color shifts of yellow and cyan.

8. The method for regulating the color shift in the white balance procedure of the four-color display device according to claim 6, wherein n is less than a gray-scale value corresponding to an inflexion of a chromaticity curve after white balance in a four-color pixel system.

9. The method for regulating the color shift in the white balance procedure of the four-color display device according to claim 1, wherein the three-color balance refers to matching the white color, and meanwhile balancing color shifts of violet and orange, or meanwhile balancing color shifts of violet and yellow, or meanwhile balancing color shifts of violet and cyan, or meanwhile balancing color shifts of orange and yellow, or meanwhile balancing color shifts of orange and cyan, or meanwhile balancing color shifts of yellow and cyan.

10. The method for regulating the color shift in the white balance procedure of the four-color display device according to claim 1, wherein in step S20, in situation of the four-color balance, weighting factors are assigned according to following ways, so that color shift in white balance procedure of the four-color display device is regulated:

dividing gray-scale values from 0 to 255 into two sections: 0 to n and n+1 to 255, four weighting factors k, l, m, and n corresponding to the section o to n, another four weighting factors o, p, q, and r corresponding to the section n+1 to 255;

assuming target chromaticities of the white color as $x_1$ and $y_1$, and target chromaticities of three shifting colors as ($x_2$, $y_2$), ($x_3$, $y_3$), and $x_4$, $y_4$;

thus, $k\times x_1+l\times x_2+m\times x_3+n\times x_4=(X(R_o)+X(G_o)+X(B_o)+X(M_o))/S$, $k\times y+l\times y_2+m\times y_3+n\times y_4=(Y(R_o)+Y(G_o)+Y(B_o)+Y(M_o))/S$, when 0≤input gray-scale value≤n; and $o\times x_1+p\times x_2+q\times x_3+r\times x_4=(X(R_o)+X(G_o)+X(B_o)+X(M_o)/S$, $o\times y_1+p\times y_2+q\times y_3+r\times y_4=(Y(R_o)+Y(G_o)+Y(B_o)+Y(M_o))S$, when n+1≤input gray-scale value≤255, wherein k+l+m+n=1, o+p+q+r=1, and $R_o$, $G_o$, $B_o$, and $M_o$ represent output four color gray-scale values;

and $$\begin{cases} M_o = f(R_o, G_o, B_o) \\ L_v(W_i)/L_v(W_{255}) = (i/255)^{2.2} \\ S = \begin{matrix} X(R_o) + Y(R_o) + Z(R_o) + X(G_o) + Y(G_o) + Z(G_o) + \\ X(B_o) + Y(B_o) + Z(B_o) + X(M_o) + Y(M_o) + Z(M_o) \end{matrix} \end{cases}$$

wherein X(·),Y(·), and Z(·) respectively represent X, Y, and Z stimulus values of each sub pixel unit, and f represents a mapping relationship from the gray-scale values of the red sub pixel unit, the green sub pixel unit, and the blue sub pixel unit to the gray-scale value of the fourth sub pixel unit which is in accordance with the three-color to four-color calculation algorithm.

11. The method for regulating the color shift in the white balance procedure of the four-color display device according to claim 10, wherein the four-color balance refers to matching the white color, and meanwhile balancing color shifts of violet, orange, and yellow, or meanwhile balancing color shifts of violet, orange, and cyan, or meanwhile balancing color shifts of violet, yellow and cyan, or meanwhile balancing color shifts of orange, yellow, and cyan.

12. The method for regulating color shift in white balance procedure of the four-color display device according to claim 10, wherein n is less than a gray-scale value corresponding to an inflexion of a chromaticity curve after white balance in a four-color pixel system.

13. The method for regulating the color shift in the white balance procedure of the four-color display device according to claim 1, wherein the four-color balance refers to matching the white color, and meanwhile balancing color shifts of violet, orange, and yellow, or meanwhile balancing color shifts of violet, orange, and cyan, or meanwhile balancing color shifts of violet, yellow and cyan, or meanwhile balancing color shifts of orange, yellow, and cyan.

14. A method for regulating color shift in a white balance procedure of a four-color display device, comprising steps of:

S10: obtaining brightness of a white color displayed by a combination according to stimulus values Y of a red sub pixel unit, a green sub pixel unit, a blue pixel unit, and a fourth sub pixel unit, which equals to brightness of a corresponding standard white gamma curve in gray-scale values from 0 to 255; and S20: balancing a white color and one shifting color, or the white color and two shifting colors, or the white color and three shifting colors using a weighting factor in case of a two-color balance, a three-color balance, or a four-color balance;

wherein the three-color balance refers to matching the white color, and meanwhile balancing color shifts of violet and orange, or meanwhile balancing color shifts of violet and yellow, or meanwhile balancing color shifts of violet and cyan, or meanwhile balancing color shifts of orange and yellow, or meanwhile balancing color shifts of orange and cyan, or meanwhile balancing color shifts of yellow and cyan.

15. The method for regulating the color shift in the white balance procedure of the four-color display device according to claim 14, wherein in step S20, in situation of the two-color balance, weighting factors are assigned according to following ways, so that the color shift in the white balance procedure of the four-color display device is regulated:

dividing gray-scale values from 0 to 255 into two sections: 0 to n and n+1 to 255, two weighting factors a and b corresponding to the section o to n, another two weighting factors c and d corresponding to the section n+1 to 255;

assuming target chromaticities of the white color as $x_i$ and $y_i$, and target chromaticities of a shifting color as $x_2$ and $y_2$;

thus, $a \times x_1 + b \times x_2 = (X(R_o) + X(G_o) + X(B_o) + X(M_o))/S$, $a \times y_1 + b \times y_2 = (Y(R_o) + Y(G_o) + Y(B_o) + Y(M_o))/S$, when 0≤input gray-scale value≤n; and $c \times x_1 + d \times x_2 (X(R_o) + X(G_o) + X(B_o) + X(M_o))/S$, $c \times y_1 + d \times y_2 = (Y(R_o) + Y(G_o) + Y(B_o) + Y(M_o))/S$, when n+1≤input gray-scale value≤255, wherein a+b=1, c+d=1, and $R_o$, $G_o$, $B_o$, and $M_o$ represent output four color gray-scale values; and $$\begin{cases} M_o = f(R_o, G_o, B_o) \\ L_v(W_i)/L_v(W_{255}) = (i/255)^{2.2} \\ S = X(R_o) + Y(R_o) + Z(R_o) + X(G_o) + Y(G_o) + Z(G_o) + \\ X(B_o) + Y(B_o) + Z(B_o) + X(M_o) + Y(M_o) + Z(M_o) \end{cases}$$

wherein X(·),Y(·), and Z(·) respectively represent X, Y, and Z stimulus values of each sub pixel unit, and f represents a mapping relationship from the gray-scale values of the red sub pixel unit, the green sub pixel unit, and the blue sub pixel unit to the gray-scale value of the fourth sub pixel unit which is in accordance with the three-color to four-color calculation algorithm.

16. The method for regulating the color shift in the white balance procedure of the four-color display device according to claim 14, wherein in step S20, in situation of the three-color balance, weighting factors are assigned according to following ways, so that color shift in white balance procedure of the four-color display device is regulated:

dividing gray-scale values from 0 to 255 into two sections: 0 to n and n+1 to 255, three weighting factors e, f, and g corresponding to the section o to n, another three weighting factors h, i, and j corresponding to the section n+1 to 255;

assuming target chromaticities of the white color as $x_1$ and $y_1$, and target chromaticities of two shifting colors as $x_2$, $y_2$ and $x_3$, $y_3$;

thus, $e \times x_1 + f \times x_2 + g \times x_3 = (X(R_o) + X(G_o) + X(B_o) + X(M_o))/S$, $e \times y_1 + f \times y_2 + g \times y_3 = (Y(R_o) + Y(G_o) + Y(B_o) + Y(M_o))/S$, when 0≤input gray-scale value≤n; and $h \times x_1 + i \times x_2 + j \times x_3 = (X(R_o) + X(G_o) + X(B_o) + X(M_o))/S$, $h \times y_1 + i \times y_2 + j \times y_3 = (Y(R_o) + Y(G_o) + Y(B_o) + Y(M_o))/S$, when n+11 input gray-scale value≤255, wherein e+f+g=1, h+i+j=1, and $R_o$, $G_o$, $B_o$, and $M_o$ represent output four color gray-scale values;

and $$\begin{cases} M_o = f(R_o, G_o, B_o) \\ L_v(W_i)/L_v(W_{255}) = (i/255)^{2.2} \\ S = X(R_o) + Y(R_o) + Z(R_o) + X(G_o) + Y(G_o) + Z(G_o) + \\ X(B_o) + Y(B_o) + Z(B_o) + X(M_o) + Y(M_o) + Z(M_o) \end{cases}$$

wherein X(·),Y(·), and Z(·) respectively represent X, Y, and Z stimulus values of each sub pixel unit, and f represents a mapping relationship from the gray-scale values of the red sub pixel unit, the green sub pixel unit, and the blue sub pixel unit to the gray-scale value of the fourth sub pixel unit which is in accordance with the three-color to four-color calculation algorithm.

17. The method for regulating the color shift in the white balance procedure of the four-color display device according to claim 14, wherein in step S20, in situation of the four-color balance, weighting factors are assigned according to following ways, so that color shift in white balance procedure of the four-color display device is regulated:

dividing gray-scale values from 0 to 255 into two sections: 0 to n and n+1 to 255, four weighting factors k, l, m, and n corresponding to the section o to n, another four weighting factors o, p, q, and r corresponding to the section n+1 to 255;

assuming target chromaticities of the white color as $x_1$ and $y_1$, and target chromaticities of three shifting colors as $(x_2, y_2)$, $(x_3, y_3)$, and $x_4$, $y_4$;

thus, $k\times+l\times x_2+m\times x_3+n\times x_4=(X(R_o)+X(G_o)+X(B_o)+X(M_o))/S$, $k\times y_1+l\times y_2+m\times y_3+n\times y_4=(Y(R_o)+Y(G_o)+Y(B_o)+Y(M_o)S$, when 0≤input gray-scale value≤n; and $o\times x_1+p\times x_2+q\times x_3+r\times x_4=(X(R_o)+X(G_o)+X(B_o)+X(M_o)/S$, $o\times y+p\times y_2+q\times y_3+r\times y_4=(Y(R_o)+Y(G_o)+Y(B_o)+Y(M_o))S$, when n+1≤input gray-scale value≤255, wherein k+l+m+n=1, o+p+q+r=1, and $R_o$, $G_o$, $B_o$, and $M_o$ represent output four color gray-scale values;

and $$\begin{cases} M_o = f(R_o, G_o, B_o) \\ L_v(W_i)/L_v(W_{255}) = (i/255)^{2.2} \\ S = X(R_o) + Y(R_o) + Z(R_o) + X(G_o) + Y(G_o) + Z(G_o) + \\ X(B_o) + Y(B_o) + Z(B_o) + X(M_o) + Y(M_o) + Z(M_o) \end{cases}$$

wherein X(·),Y(·), and Z(·) respectively represent X, Y, and Z stimulus values of each sub pixel unit, and f represents a mapping relationship from the gray-scale values of the red sub pixel unit, the green sub pixel unit, and the blue sub pixel unit to the gray-scale value of the fourth sub pixel unit which is in accordance with the three-color to four-color calculation algorithm.

18. A method for regulating color shift in a white balance procedure of a four-color display device, comprising steps of:

S10: obtaining brightness of a white color displayed by a combination according to stimulus values Y of a red sub pixel unit, a green sub pixel unit, a blue pixel unit, and a fourth sub pixel unit, which equals to brightness of a corresponding standard white gamma curve in gray-scale values from 0 to 255; and S20: balancing a white color and one shifting color, or the white color and two shifting colors, or the white color and three shifting colors using a weighting factor in case of a two-color balance, a three-color balance, or a four-color balance;

wherein the four-color balance refers to matching the white color, and meanwhile balancing color shifts of violet, orange, and yellow, or meanwhile balancing color shifts of violet, orange, and cyan, or meanwhile balancing color shifts of violet, yellow and cyan, or meanwhile balancing color shifts of orange, yellow, and cyan.

19. The method for regulating the color shift in the white balance procedure of the four-color display device according to claim 18, wherein in step S20, in situation of the two-color balance, weighting factors are assigned according to following ways, so that the color shift in the white balance procedure of the four-color display device is regulated:

dividing gray-scale values from 0 to 255 into two sections: 0 to n and n+1 to 255, two weighting factors a and b corresponding to the section o to n, another two weighting factors c and d corresponding to the section n+1 to 255;

assuming target chromaticities of the white color as $x_1$ and $y_1$, and target chromaticities of a shifting color as $x_2$ and $y_2$;

thus, $a\ x_1+b\times x_2=(X(R_o)+X(G_o)+X(B_o)+X(M_o))/S$, $a\times y_1+b\times y_2=(Y(R_o)+Y(G_o)+Y(B_o)+Y(M_o))/S$, when 0≤input gray-scale value≤n; and $c\times x_1+d\times x_2=(X(R_o)+X(G_o)++X(M_o))/S$, $c\times y_1+d\times y_2=(Y(R_o)+Y(G_o)+Y(B_o)+Y(M_o))/S$, when n+1≤input gray-scale value≤255, wherein a+b=1, c+d=1, and $R_o$, $G_o$, $B_o$, and $M_o$ represent output four color gray-scale values; and $$\begin{cases} M_o = f(R_o, G_o, B_o) \\ L_v(W_i)/L_v(W_{255}) = (i/255)^{2.2} \\ S = X(R_o) + Y(R_o) + Z(R_o) + X(G_o) + Y(G_o) + Z(G_o) + \\ X(B_o) + Y(B_o) + Z(B_o) + X(M_o) + Y(M_o) + Z(M_o) \end{cases}$$

wherein X(·),Y(·), and Z(·) respectively represent X, Y, and Z stimulus values of each sub pixel unit, and f represents a mapping relationship from the gray-scale values of the red sub pixel unit, the green sub pixel unit, and the blue sub pixel unit to the gray-scale value of the fourth sub pixel unit which is in accordance with the three-color to four-color calculation algorithm.

20. The method for regulating the color shift in the white balance procedure of the four-color display device according to claim 18, wherein in step S20, in situation of the three-color balance, weighting factors are assigned according to following ways, so that color shift in white balance procedure of the four-color display device is regulated:

dividing gray-scale values from 0 to 255 into two sections: 0 to n and n+1 to 255, three weighting factors e, f, and g corresponding to the section o to n, another three weighting factors h, i, and j corresponding to the section n+1 to 255;

assuming target chromaticities of the white color as $x_1$ and $y_1$, and target chromaticities of two shifting colors as $x_2$, $y_2$ and $x_3$, $y_3$;

thus, $e\times x_1+f\times x_2+g\times x_3=(X(R_o)+X(G_o)+X(B_o)+X(M_o))/S$, $e\times y_1+f\times y_2+g\times y_3=(Y(R_o)+Y(G_o)+Y(B_o)+Y(M_o))/S$, when 0≤input gray-scale value≤n; and $h\times x_1+i\times x_2+j\times x_3=(X(R_o)+X(G_o)+X(B_o)+X(M_o))/S$, $h\times y_1+i\times y_2+j\times y_3=(Y(R_o)+Y(G_o)+Y(B_o)+Y(M_o))/S$, when n+11 input gray-scale value≤255, wherein e+f+g=1, h+i+j=1, and $R_o$, $G_o$, $B_o$, and $M_o$ represent output four color gray-scale values;

and $$\begin{cases} M_o = f(R_o, G_o, B_o) \\ L_v(W_i)/L_v(W_{255}) = (i/255)^{2.2} \\ S = X(R_o) + Y(R_o) + Z(R_o) + X(G_o) + Y(G_o) + Z(G_o) + \\ X(B_o) + Y(B_o) + Z(B_o) + X(M_o) + Y(M_o) + Z(M_o) \end{cases}$$

wherein X(·),Y(·), and Z(·) respectively represent X, Y, and Z stimulus values of each sub pixel unit, and f represents a mapping relationship from the gray-scale values of the red sub pixel unit, the green sub pixel unit, and the blue sub pixel unit to the gray-scale value of the fourth sub pixel unit which is in accordance with the three-color to four-color calculation algorithm.

* * * * *